US010145179B2

(12) United States Patent
Cook, III et al.

(10) Patent No.: US 10,145,179 B2
(45) **Date of Patent: *Dec. 4, 2018**

(54) FIBER-REINFORCED TOOLS FOR DOWNHOLE USE

(71) Applicant: Halliburton Energy Services, Inc., Houston, TX (US)

(72) Inventors: Grant O. Cook, III, Spring, TX (US); Garrett T. Olsen, The Woodlands, TX (US); Daniel Brendan Voglewede, Spring, TX (US); Jeffrey G. Thomas, Magnolia, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 242 days.

This patent is subject to a terminal disclaimer.

(21) Appl. No.: 14/647,960

(22) PCT Filed: Dec. 11, 2014

(86) PCT No.: PCT/US2014/069706
§ 371 (c)(1),
(2) Date: May 28, 2015

(87) PCT Pub. No.: WO2015/089267
PCT Pub. Date: Jun. 18, 2015

(65) Prior Publication Data

US 2015/0368980 A1 Dec. 24, 2015

Related U.S. Application Data

(63) Continuation-in-part of application No. PCT/US2013/075061, filed on Dec. 13, 2013.

(51) Int. Cl.
*E21B 10/60* (2006.01)
*E21B 10/46* (2006.01)
(Continued)

(52) U.S. Cl.
CPC ..... *E21B 10/46* (2013.01); *C22C 26/00* (2013.01); *C22C 29/005* (2013.01); *C22C 29/02* (2013.01);
(Continued)

(58) Field of Classification Search
CPC ..... E21B 10/46; E21B 10/42; E21B 10/54; E21B 17/00; E21B 17/1078; E21B 33/12;
(Continued)

(56) References Cited

U.S. PATENT DOCUMENTS 6,009,843 A 1/2000 Griffin et al.
7,264,879 B2 9/2007 Sue et al.
(Continued)

FOREIGN PATENT DOCUMENTS

EP 1046724 A2 10/2000
WO 9908033 A1 2/1999
(Continued)

OTHER PUBLICATIONS

International Search Report and Written Opinion for PCT/US2014/069706 dated Mar. 31, 2015.
(Continued)

*Primary Examiner* — Taras P Bemko
(74) *Attorney, Agent, or Firm* — Alan Bryson; Tumey L.L.P.

(57) ABSTRACT

A wellbore tool may be formed, at least in part, by a fiber-reinforced hard composite portion. The fiber-reinforced hard composite portion can include reinforcing particles and reinforcing fibers dispersed in a binder, wherein the reinforcing fibers have an aspect ratio ranging from 1 to 15 times a critical aspect ratio ($A_c$). The critical aspect ratio can be determined using the equation $A_c=\sigma_f/(2\tau_c)$, wherein $\sigma_f$ is an ultimate tensile strength of the reinforcing fibers, and $\tau_c$ is an interfacial shear bond strength between the reinforc-
(Continued)

ing fiber and the binder or a yield stress of the binder, whichever is lower.

21 Claims, 9 Drawing Sheets

(51) Int. Cl.

| | |
|---|---|
| ***E21B 17/10*** | (2006.01) |
| ***E21B 33/12*** | (2006.01) |
| ***E21B 17/00*** | (2006.01) |
| ***E21B 10/42*** | (2006.01) |
| ***E21B 10/54*** | (2006.01) |
| ***C22C 26/00*** | (2006.01) |
| ***C22C 29/00*** | (2006.01) |
| ***C22C 29/02*** | (2006.01) |
| ***C22C 29/16*** | (2006.01) |
| ***C22C 47/14*** | (2006.01) |
| *B22F 1/02* | (2006.01) |
| *B22F 5/00* | (2006.01) |

(52) U.S. Cl.
CPC ..... *C22C 29/16* (2013.01); *C22C 47/14* (2013.01); *E21B 10/42* (2013.01); *E21B 10/54* (2013.01); *E21B 17/00* (2013.01); *E21B 17/1078* (2013.01); *E21B 33/12* (2013.01); *B22F 1/025* (2013.01); *B22F 2005/001* (2013.01)

(58) Field of Classification Search
CPC ..... C22C 26/00; C22C 29/005; C22C 29/02; C22C 29/16; C22C 47/14; B22F 1/025; B22F 2005/001
USPC ..... 175/374
See application file for complete search history.

(56) References Cited

U.S. PATENT DOCUMENTS

| | | | |
|---|---|---|---|
| 7,343,677 | B2 | 3/2008 | Twigg |
| 7,695,542 | B2 | 4/2010 | Drivdahl et al. |
| 7,975,785 | B2 | 7/2011 | Drivdahl et al. |
| 8,123,486 | B2 | 2/2012 | Carrier et al. |
| 8,191,445 | B2 | 6/2012 | Drivdahl et al. |
| 8,647,453 | B2 | 2/2014 | Doorbar |
| 2004/0063845 | A1 | 4/2004 | Guzauskas |
| 2008/0128170 | A1 | 6/2008 | Drivdahl et al. |
| 2008/0209818 | A1 | 9/2008 | Belnap et al. |
| 2010/0155148 | A1 | 6/2010 | Choe et al. |
| 2010/0263935 | A1 | 10/2010 | Smith et al. |
| 2011/0107586 | A1 | 5/2011 | Choe et al. |
| 2011/0252711 | A1* | 10/2011 | Chakraborty ..... B01J 3/062 51/298 |
| 2011/0252712 | A1* | 10/2011 | Chakraborty ..... B01J 3/062 51/298 |
| 2011/0252713 | A1* | 10/2011 | Chakraborty ..... B01J 3/062 51/298 |
| 2012/0260581 | A1* | 10/2012 | Pearce ..... C22C 1/1084 51/309 |
| 2013/0000982 | A1 | 1/2013 | Olsen |
| 2013/0121777 | A1 | 5/2013 | Gey et al. |
| 2013/0180786 | A1 | 7/2013 | Thomas et al. |
| 2013/0247475 | A1 | 9/2013 | Lind et al. |
| 2016/0265282 | A1 | 9/2016 | Olsen |

FOREIGN PATENT DOCUMENTS

| | | | |
|---|---|---|---|
| WO | WO-2010/075186 | A2 | 7/2010 |
| WO | 2015088560 | A1 | 6/2015 |
| WO | 2015089267 | A1 | 6/2015 |

OTHER PUBLICATIONS

International Search Report and Written Opinion for PCT/US2013/075061 dated Sep. 17, 2014.
Jech, Robert W., NASA Technical Memorandum X-3311, Critical Aspect Ratio for Tungsten Fibers in Copper-Nickel Matrix Composites, 1976.
Weeton et al., NASA Technical Memorandum D-3530, Fiber-Metal Composite Materials, 1965.
Chinese Office Action from Chinese Application No. 201480061122.X, dated Feb. 23, 2017.

* cited by examiner

FIBER-REINFORCED TOOLS FOR DOWNHOLE USE

BACKGROUND

The present disclosure relates to reinforced tools for downhole use, including but not limited to fiber-reinforced drill bits, along with associated methods of production and use related thereto.

A wide variety of tools are used downhole in the oil and gas industry, including tools for forming wellbores, tools used in completing wellbores that have been drilled, and tools used in producing hydrocarbons such as oil and gas from the completed wells. Cutting tools, in particular, are frequently used to drill oil and gas wells, geothermal wells and water wells. Cutting tools may include roller-cone drill bits, fixed-cutter drill bits, reamers, coring bits, and the like. For example, fixed-cutter drill bits are often formed with a matrix bit body having cutting elements or inserts disposed at select locations about the exterior of the matrix bit body. During drilling, these cutting elements engage and remove adjacent portions of the subterranean formation.

Composite materials may be used in a matrix bit body of a fixed-cutter bit. Such materials are generally erosion-resistant and exhibit high impact strength. However, such composite materials can be brittle. As a result, stress cracks can occur because of the thermal stresses experienced during manufacturing or the mechanical stresses conveyed during drilling. This is especially true as erosion of the composite materials accelerates.

BRIEF DESCRIPTION OF THE DRAWINGS

The following figures are included to illustrate certain aspects of the embodiments, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

Figure 1:
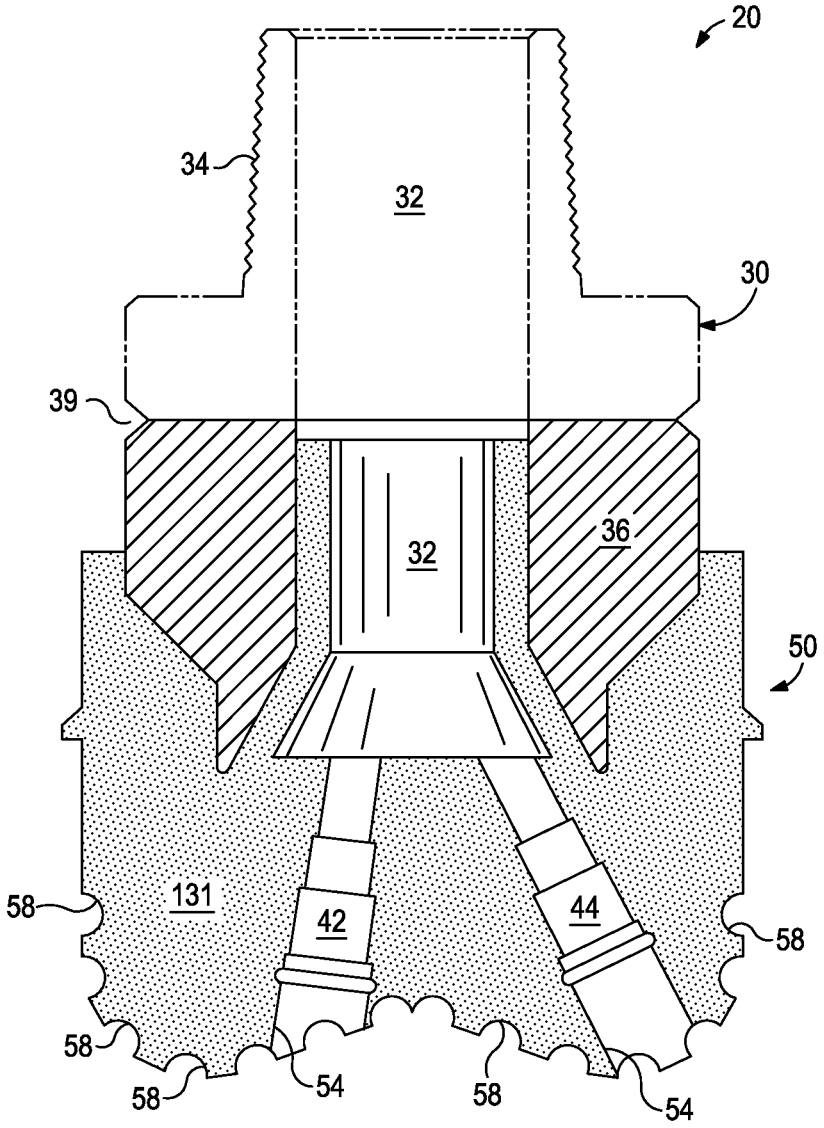
FIG. 1 is a cross-sectional view showing one example of a drill bit having a matrix bit body with at least one fiber-reinforced portion in accordance with the teachings of the present disclosure.

The present disclosure relates to fiber-reinforced downhole tools, and methods of manufacturing and using such fiber-reinforced downhole tools. The teachings of this disclosure can be applied to any downhole tool that can be formed at least partially of composite materials and which experiences wear during contact with the borehole or other downhole devices. Such tools may include tools for drilling wells, completing wells, and producing hydrocarbons from wells. Examples of such tools include cutting tools such as drill bits, reamers, stabilizers, and coring bits; drilling tools such as rotary steerable devices, mud motors; and other tools used downhole such as window mills, packers, tool joints, and other wear-prone tools.

By way of example, several embodiments pertain, more particularly, to a drill bit having a matrix bit body with at least one fiber-reinforced portion. The matrix bit body with at least one fiber-reinforced portion is alternately referred to herein as a fiber-reinforced matrix bit body, since at least one portion is fiber-reinforced. In some embodiments, the wellbore tools or portions thereof of the present disclosure may be formed, at least in part, with a fiber-reinforced hard composite portion that includes reinforcing particles and reinforcing fibers dispersed in a binder material. As used herein, the term "reinforcing fiber" refers to a fiber having an aspect ratio ranging from 1 to 15 times a critical aspect ratio ($A_c$), wherein $A_c=\sigma_f/(2T_c)$, $\sigma_f$ is an ultimate tensile strength of the reinforcing fibers, and $T_c$ is an interfacial shear bond strength between the reinforcing fiber and the binder or a yield stress of the binder, whichever is lower. As used herein the term "fiber" encompasses fibers, whiskers, rods, wires, dog bones, ribbons, discs, wafers, flakes, rings, and the like, and hybrids thereof. As used herein, the term "dog bone" refers to an elongated structure like a fiber, whisker, or rod where the diameter at or near the ends of the structure are greater than the diameter anywhere therebetween. As used herein, the aspect ratio of a 2-dimensional structure (e.g., ribbons, discs, wafers, flakes, or rings) refers to the ratio of the longest dimension to the thickness.

Without being limited by theory, it is believed that the plurality of fibers, due at least in part to their composition and aspect ratio, will reinforce the surrounding composite material to resist crack initiation and propagation through the fiber-reinforced hard composite portion of the wellbore tool or portion thereof. Mitigating crack initiation and propagation may reduce the scrap rate during production and increase the lifetime of the wellbore tools once in use.

In some embodiments, the reinforcing fibers described herein may have an aspect ratio ranging from a lower limit of 2, 5, 10, 50, 100, or 250 to an upper limit of 500, 250, 100, 50, or 25 wherein the aspect ratio of the reinforcing fibers may range from any lower limit to any upper limit and encompasses any subset therebetween. In some embodiments, two or more reinforcing fibers that differ at least in aspect ratio may be used in fiber-reinforced hard composite portions described herein.

In some embodiments, the reinforcing fibers described herein may have a diameter ranging from a lower limit of 1 micron, 10 microns, or 25 microns to an upper limit of 300 microns, 200 microns, 100 microns, or 50 microns, wherein the diameter of the reinforcing fibers may range from any lower limit to any upper limit and encompasses any subset therebetween. One skilled in the art would recognize the length of the reinforcing fibers will depend on the diameter of the reinforcing fibers and the critical aspect ratio of the reinforcing fibers relative to the binder in which the reinforcing fibers are implemented and the composition of the reinforcing fibers. In some embodiments, two or more reinforcing fibers that differ at least in diameter may be used in fiber-reinforced hard composite portions described herein.

The reinforcing fibers described herein may preferably have a composition that bonds with the binder, so that an increased amount of thermal and mechanic stresses (or loads) can be transferred to the fibers. Further, a composition that bonds with the binder may be less likely to pull out from the binder as a crack propagates.

Additionally, the composition of the reinforcing fibers may preferably endure temperatures and pressures experienced when forming a fiber-reinforced hard composite portion (described in more detail herein) with little to no alloying with the binder material or oxidation. However, in some instances, the atmospheric conditions may be changed (e.g., reduced oxygen content achieved via reduced pressures or gas purge) to mitigate oxidation of the reinforcing fibers to allow for a composition that may not be suitable for use in standard atmospheric oxygen concentrations.

In some embodiments, the composition of the reinforcing fibers may have a melting point greater than the melting point of the binder (e.g., greater than 1000° C.). In some embodiments, the composition of the reinforcing fibers may have a melting point ranging from a lower limit of 1000° C., 1250° C., 1500° C., or 2000° C. to an upper limit of 3800° C., 3500° C., 3000° C., or 2500° C., wherein the melting point of the composition may range from any lower limit to any upper limit and encompasses any subset therebetween.

In some embodiments, the composition of the reinforcing fibers may have an oxidation temperature for the given atmospheric conditions that is greater than the melting point of the binder (e.g., greater than 1000° C.). In some embodiments, the composition of the reinforcing fibers may have an oxidation temperature for the given atmospheric conditions ranging from a lower limit of 1000° C., 1250° C., 1500° C., or 2000° C. to an upper limit of 3800° C., 3500° C., 3000° C., or 2500° C., wherein the oxidation temperature of the composition may range from any lower limit to any upper limit and encompasses any subset therebetween.

Examples of compositions of the reinforcing fibers for use in conjunction with the embodiments described herein may include, but are not limited to, tungsten, molybdenum, niobium, tantalum, rhenium, iridium, ruthenium, beryllium, titanium, chromium, rhodium, iron, cobalt, uranium, nickel, steels, stainless steels, austenitic steels, ferritic steels, martensitic steels, precipitation-hardening steels, duplex stainless steels, iron alloys, nickel alloys, chromium alloys, carbon, refractory ceramic, silicon carbide, silica, silicon nitride, alumina, titania, mullite, zirconia, boron nitride, boron carbide, titanium carbide, titanium nitride, tungsten carbide, and the like, and any combination thereof. In some embodiments, two or more reinforcing fibers that differ at least in composition may be used in fiber-reinforced hard composite portions described herein.

In some embodiments, a fiber-reinforced hard composite portion described herein may include reinforcing fibers at a concentration ranging from a lower limit of 1%, 3%, or 5% by weight of the reinforcing particles to an upper limit of 30%, 20%, or 10% by weight of the reinforcing particles, wherein the concentration of reinforcing fibers may range from any lower limit to any upper limit and encompasses any subset therebetween.

Examples of binders suitable for use in conjunction with the embodiments described herein may include, but are not limited to, copper, nickel, cobalt, iron, aluminum, molybdenum, chromium, manganese, tin, zinc, lead, silicon, tungsten, boron, phosphorous, gold, silver, palladium, indium, any mixture thereof, any alloy thereof, and any combination thereof. Nonlimiting examples of binders may include copper-phosphorus, copper-phosphorous-silver, copper-manganese-phosphorous, copper-nickel, copper-manganese-nickel, copper-manganese-zinc, copper-manganese-nickel-zinc, copper-nickel-indium, copper-tin-manganese-nickel, copper-tin-manganese-nickel-iron, gold-nickel, gold-palladium-nickel, gold-copper-nickel, silver-copper-zinc-nickel, silver-manganese, silver-copper-zinc-cadmium, silver-copper-tin, cobalt-silicon-chromium-nickel-tungsten, cobalt-silicon-chromium-nickel-tungsten-boron, manganese-nickel-cobalt-boron, nickel-silicon-chromium, nickel-chromium-silicon-manganese, nickel-chromium-silicon, nickel-silicon-boron, nickel-silicon-chromium-boron-iron, nickel-phosphorus, nickel-manganese, copper-aluminum, copper-aluminum-nickel, copper-aluminum-nickel-iron, copper-aluminum-nickel-zinc-tin-iron, and the like, and any combination thereof. Examples of commercially available binders may include, but are not limited to, VIRGIN™ Binder 453D (copper-manganese-nickel-zinc, available from Belmont Metals, Inc.); copper-tin-manganese-nickel and copper-tin-manganese-nickel-iron grades 516, 519, 523, 512, 518, and 520 available from ATI Firth Sterling; and any combination thereof.

While the composition of some of the reinforcing fibers and binders may overlap, one skilled in the art would recognize that the composition of reinforcing fibers should be chosen to have a melting point greater than the fiber-reinforced hard composite portion production temperature, which is at or higher than the melting point of the binder.

In some instances, reinforcing particles suitable for use in conjunction with the embodiments described herein may include particles of metals, metal alloys, metal carbides, metal nitrides, ceramics, intermetallics, diamonds, superalloys, and the like, or any combination thereof. Examples of reinforcing particles suitable for use in conjunction with the embodiments described herein may include particles that include, but not be limited to, tungsten, molybdenum, niobium, tantalum, rhenium, iridium, ruthenium, beryllium, titanium, chromium, rhodium, iron, cobalt, uranium, nickel, nitrides, silicon nitrides, boron nitrides, cubic boron nitrides, natural diamonds, synthetic diamonds, cemented carbide, spherical carbides, low alloy sintered materials, cast carbides, silicon carbides, boron carbides, cubic boron carbides, molybdenum carbides, titanium carbides, tantalum carbides, niobium carbides, chromium carbides, vanadium carbides, iron carbides, tungsten carbides, macrocrystalline tungsten carbides, cast tungsten carbides, crushed sintered tungsten carbides, carburized tungsten carbides, steels, stainless steels, austenitic steels, ferritic steels, martensitic steels, precipitation-hardening steels, duplex stainless steels, ceramics, iron alloys, nickel alloys, chromium alloys, HASTELLOY® alloys (nickel-chromium containing alloys, available from Haynes International), INCONEL® alloys (austenitic nickel-chromium containing superalloys, available from Special Metals Corporation), WASPALOYS® (austenitic nickel-based superalloys), RENE® alloys (nickel-chrome containing alloys, available from Altemp Alloys, Inc.), HAYNES® alloys (nickel-chromium containing superalloys, available from Haynes International), INCOLOY® alloys (iron-nickel containing superalloys, available from Mega Mex), MP98T (a nickel-copper-chromium superalloy, available from SPS Technologies), TMS alloys, CMSX® alloys (nickel-based superalloys, available from C-M Group), N-155 alloys, any mixture thereof, and any combination thereof. In some embodiments, the reinforcing particles may be coated. By way of nonlimiting example, the reinforcing particles may comprise diamond coated with titanium.

In some embodiments, the reinforcing particles described herein may have a diameter ranging from a lower limit of 1 micron, 10 microns, 50 microns, or 100 microns to an upper limit of 1000 microns, 800 microns, 500 microns, 400 microns, or 200 microns, wherein the diameter of the reinforcing particles may range from any lower limit to any upper limit and encompasses any subset therebetween.

In some embodiments, the fiber-reinforced hard composite portion of the wellbore tool or portion thereof may include reinforcing fibers and reinforcing particles each with distinct diameter distributions, which may be similar or different. Without being limited by theory, it is believed that larger diameter fibers and particles impart erosion resistance to the fiber-reinforced hard composite while smaller diameter fibers and particles impart toughness.

In some instances, the diameter distributions of each of the reinforcing fibers and reinforcing particles may be chosen such that one of the foregoing is skewed to higher diameters and the other is skewed to lower diameters. Each of the reinforcing particles and the reinforcing fibers may have a diameter distribution may be characterized by at least one $d_x$ that corresponds to the diameter at which x vol % of the reinforcing particles and the reinforcing fibers have a smaller diameter. For example, $d_{10}$ and $d_{25}$ represent diameters at which 10 vol % and 25 vol %, respectively, of the reinforcing fibers or reinforcing particles have a smaller diameter. In some instances, the reinforcing fibers or the reinforcing particles skewed to larger diameter may have a $d_{10}$ greater than the $d_{25}$ of the one skewed to smaller diameter. In some instances, the reinforcing fibers or the reinforcing particles skewed to larger diameter may have a $d_{10}$ ranging from 25 microns or greater (e.g., 25 microns to 500 microns), and the one skewed to smaller diameter may have a $d_{25}$ of 250 microns or less (e.g., 10 microns to 250 microns). By way of nonlimiting example, the reinforcing fibers may have a $d_{10}$ of 250 microns (i.e., 10% of the reinforcing fibers having a diameter less than or equal to 250 microns) and the reinforcing particles may have a $d_{25}$ of 25 microns (i.e., 50% of the reinforcing particles having a diameter less than or equal to 25 microns).

Tables 1-5 provide nonlimiting examples of diameter distributions for the reinforcing particles and reinforcing fibers that may be suitable for use together in forming a fiber-reinforced hard composite portion of a wellbore tool or portion thereof. The tables provide diameter distributions and do not imply an absolute concentration of either the reinforcing particles or the reinforcing fibers in the fiber-reinforced hard composite. Tables 1-2 illustrate diameter distributions for the reinforcing particles and reinforcing fibers where the reinforcing particles are skewed to larger diameters and the reinforcing fibers are skewed to smaller diameters. Tables 3-4 illustrate diameter distributions for the reinforcing particles and reinforcing fibers where the reinforcing fibers are skewed to larger diameters and the reinforcing particles are skewed to smaller diameters. Table 5 illustrates a diameter distribution where the reinforcing particles and reinforcing fibers are similar.

TABLE 1

| Diameter Range | Reinforcing Particles Distribution (vol %) | Reinforcing Fibers Distribution (vol %) |
|---|---|---|
| less than 10 microns | 5 | 85 |
| 10 microns to >100 microns | 25 | 10 |

TABLE 1-continued

| Diameter Range | Reinforcing Particles Distribution (vol %) | Reinforcing Fibers Distribution (vol %) |
|---|---|---|
| 100 microns to >200 microns | 40 | less than 5 |
| 200 microns to >500 microns | 20 | less than 1 |
| 500 microns and greater | 10 | less than 1 |

TABLE 2

| Diameter Range | Reinforcing Particles Distribution (vol %) | Reinforcing Fibers Distribution (vol %) |
|---|---|---|
| less than 10 microns | 0 | 85 |
| 10 microns to >100 microns | 15 | 5 |
| 100 microns to >200 microns | 50 | 5 |
| 200 microns to >500 microns | 24 | less than 5 |
| 500 microns and greater | 11 | less than 1 |

TABLE 3

| Diameter Range | Reinforcing Particles Distribution (vol %) | Reinforcing Fibers Distribution (vol %) |
|---|---|---|
| less than 10 microns | 5 | less than 1 |
| 10 microns to >100 microns | 25 | less than 1 |
| 100 microns to >200 microns | 40 | less than 5 |
| 200 microns to >500 microns | 20 | 10 |
| 500 microns and greater | 10 | 85 |

TABLE 4

| Diameter Range | Reinforcing Particles Distribution (vol %) | Reinforcing Fibers Distribution (vol %) |
|---|---|---|
| less than 10 microns | 10 | less than 1 |
| 10 microns to >100 microns | 35 | less than 1 |
| 100 microns to >200 microns | 50 | less than 1 |
| 200 microns to >500 microns | less than 5 | less than 5 |
| 500 microns and greater | less than 1 | 95 |

TABLE 5

| Diameter Range | Reinforcing Particles Distribution (vol %) | Reinforcing Fibers Distribution (vol %) |
|---|---|---|
| less than 10 microns | 5 | 5 |
| 10 microns to >100 microns | 25 | 40 |
| 100 microns to >200 microns | 40 | 50 |
| 200 microns to >500 microns | 20 | less than 5 |
| 500 microns and greater | 10 | less than 1 |

By way of nonlimiting example, FIGS. 1-8 provide examples of implementing fiber-reinforced hard composites described herein in matrix drill bits. One skilled in the art will recognize how to adapt these teachings to other wellbore tools or portions thereof.

FIG. 1 is a cross-sectional view showing one example of a matrix drill bit 20 formed with a matrix bit body 50 that comprises a fiber-reinforced hard composite portion 131 in accordance with the teachings of the present disclosure. As used herein, the term "matrix drill bit" encompasses rotary drag bits, drag bits, fixed-cutter drill bits, and any other drill bit capable of incorporating the teachings of the present disclosure.

For embodiments such as shown in FIG. 1, the matrix drill bit 20 may include a metal shank 30 with a metal blank 36 securely attached thereto (e.g., at weld location 39). The metal blank 36 extends into the matrix bit body 50. The metal shank 30 comprises a threaded connection 34 distal to the metal blank 36.

The metal shank 30 and metal blank 36 are generally cylindrical structures that at least partially define corresponding fluid cavities 32 that fluidly communicate with each other. The fluid cavity 32 of the metal blank 36 may further extend into the matrix bit body 50. At least one flow passageway (shown as two flow passageways 42 and 44) may extend from the fluid cavity 32 to the exterior portions of the matrix bit body 50. Nozzle openings 54 may be defined at the ends of the flow passageways 42 and 44 at the exterior portions of the matrix bit body 50.

Figure 2:
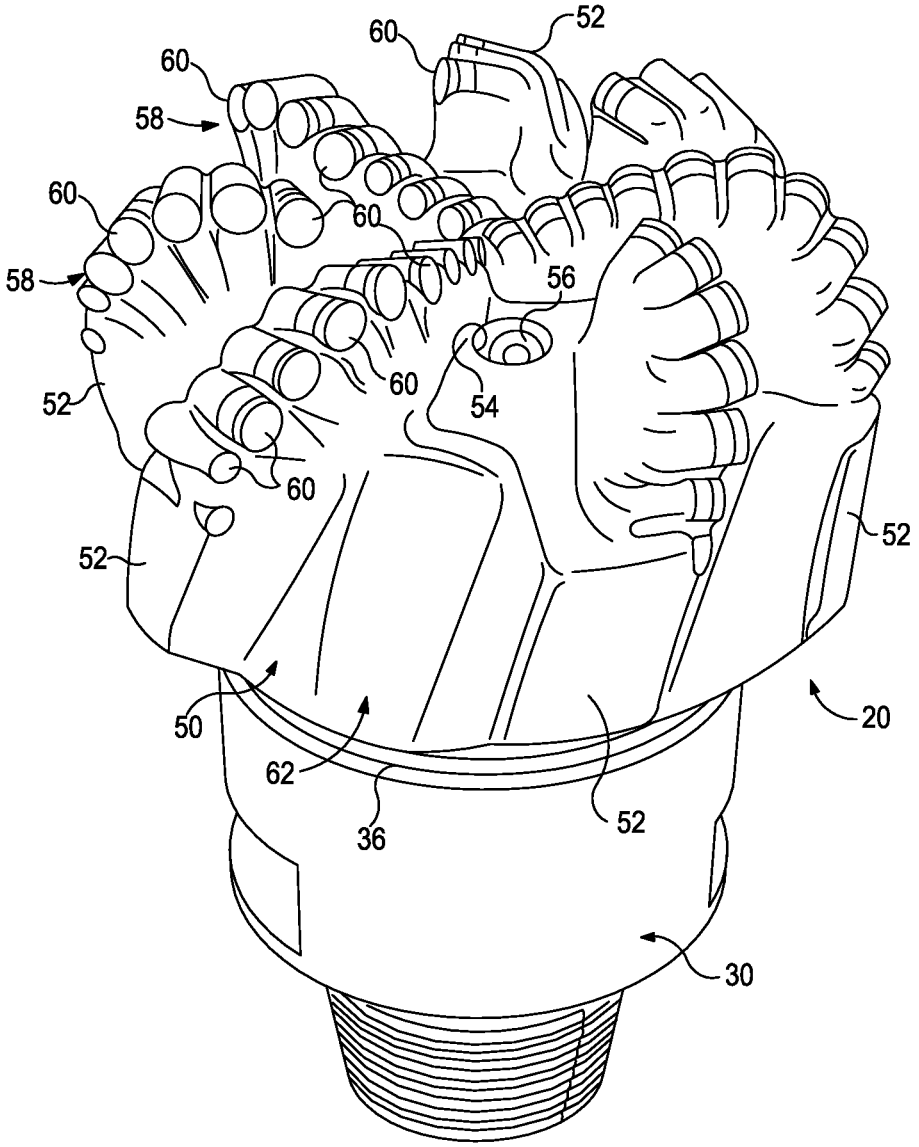
FIG. 2 is an isometric view of the drill bit of FIG. 1.

A plurality of indentations or pockets 58 are formed at the exterior portions of the matrix bit body 50 and are shaped to receive corresponding cutting elements (shown in FIG. 2).

FIG. 2 is an isometric view showing one example of a matrix drill bit 20 formed with the matrix bit body 50 that comprises a fiber-reinforced hard composite portion in accordance with the teachings of the present disclosure. As illustrated, the matrix drill bit 20 includes the metal blank 36 and the metal shank 30, as generally described above with reference to FIG. 1.

The matrix bit body 50 includes a plurality of cutter blades 52 formed on the exterior of the matrix bit body 50. Cutter blades 52 may be spaced from each other on the exterior of the composite matrix bit body 50 to form fluid flow paths or junk slots 62 therebetween.

As illustrated, the plurality of pockets 58 formed in the cutter blades 52 at selected locations receive corresponding cutting elements 60 (also known as cutting inserts), securely mounted (e.g., via brazing) in positions oriented to engage and remove adjacent portions of a subterranean formation during drilling operations. More particularly, the cutting elements 60 may scrape and gouge formation materials from the bottom and sides of a wellbore during rotation of the matrix drill bit 20 by an attached drill string (not shown). For some applications, various types of polycrystalline diamond compact (PDC) cutters may be used as cutting elements 60. A matrix drill bit having such PDC cutters may sometimes be referred to as a "PDC bit".

A nozzle 56 may be disposed in each nozzle opening 54. For some applications, nozzles 56 may be described or otherwise characterized as "interchangeable" nozzles.

A wide variety of molds may be used to form a composite matrix bit body and associated matrix drill bit in accordance with the teachings of the present disclosure.

Figure 3:
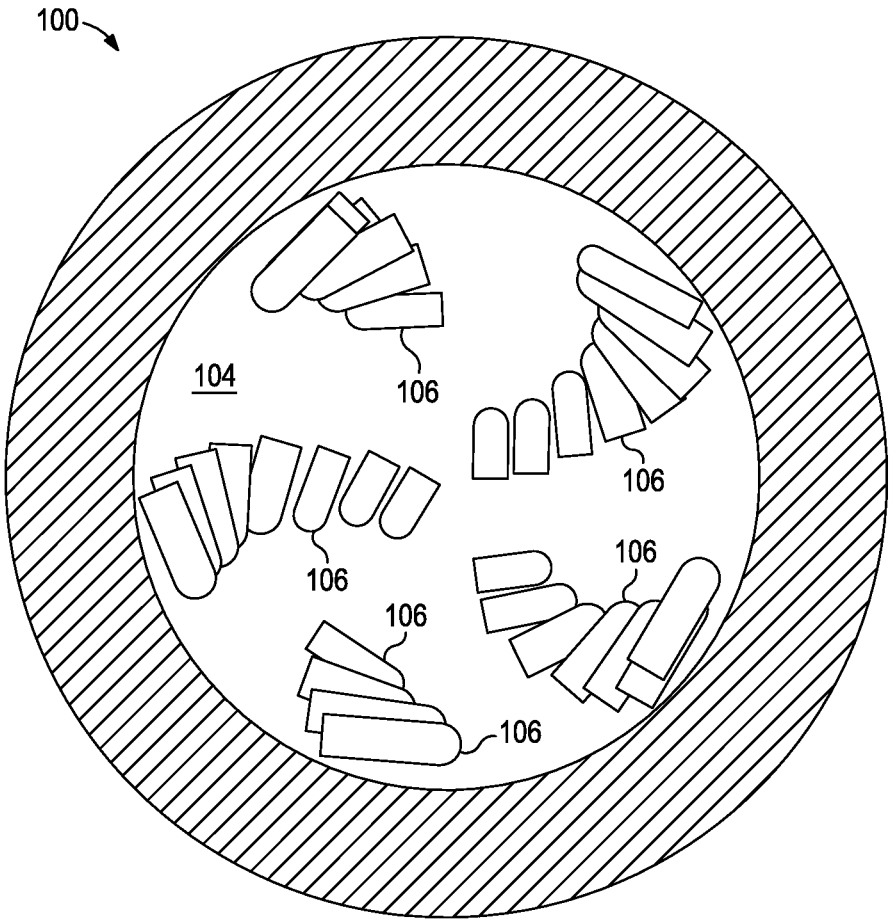
FIG. 3 is a cross-sectional view showing one example of a mold assembly for use in forming a matrix bit body in accordance with the teachings of the present disclosure.

FIG. 3 is an end view showing one example of a mold assembly 100 for use in forming a matrix bit body incorporating teachings of the present disclosure. A plurality of mold inserts 106 may be placed within a cavity 104 defined by or otherwise provided within the mold assembly 100. The mold inserts 106 may be used to form the respective pockets in blades of the matrix bit body. The location of mold inserts 106 in cavity 104 corresponds with desired locations for installing the cutting elements in the associated blades. Mold inserts 106 may be formed from various types of material such as, but not limited to, consolidated sand and graphite.

Figure 4:
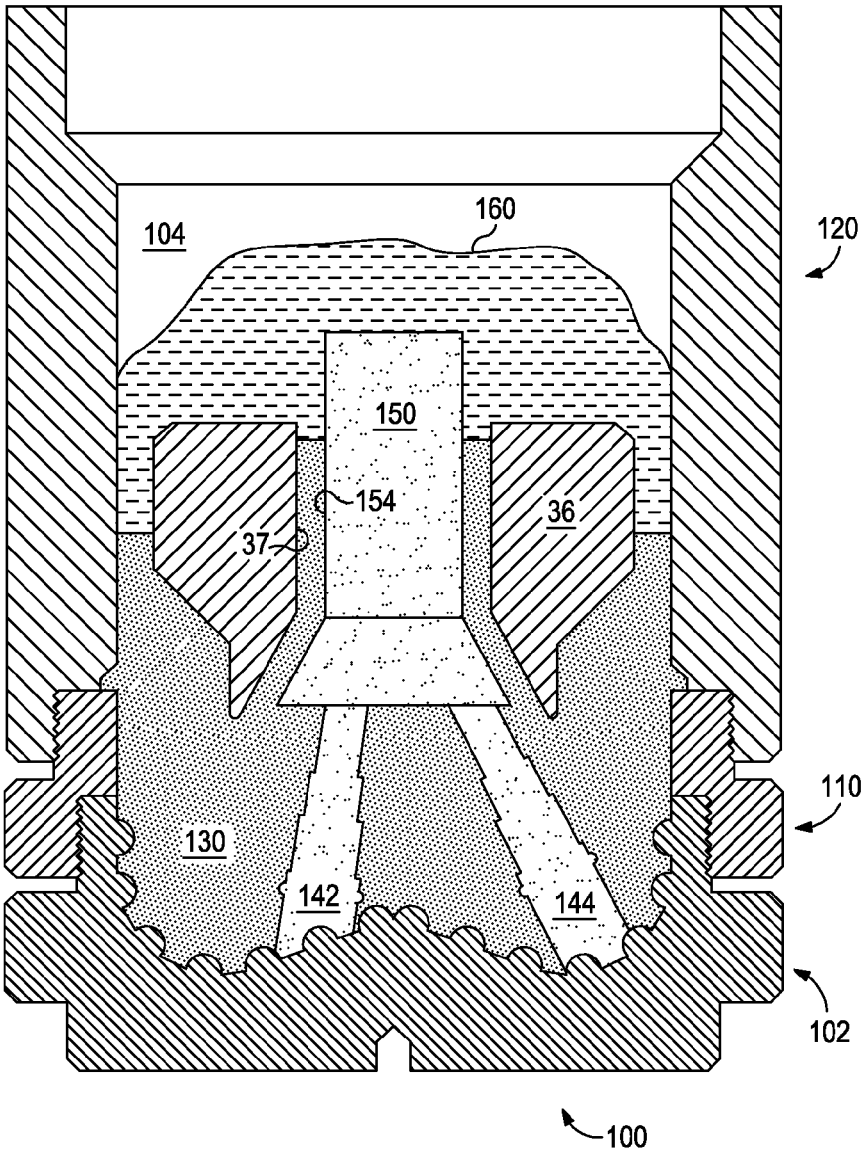
FIG. 4 is an end view showing one example of a mold assembly for use in forming a matrix bit body in accordance with the teachings of the present disclosure.

FIG. 4 is a cross-sectional view of the mold assembly 100 of FIG. 3 that may be used in forming a matrix bit body incorporating teachings of the present disclosure. The mold assembly 100 may include several components such as a mold 102, a gauge ring or connector ring 110, and a funnel 120. Mold 102, gauge ring 110, and funnel 120 may be formed from graphite or other suitable materials known to those skilled in the art. Various techniques may be used to manufacture the mold assembly 100 and components thereof including, but not limited to, machining a graphite blank to produce the mold 102 with the associated cavity 104 having a negative profile or a reverse profile of desired exterior features for a resulting matrix bit body. For example, the cavity 104 may have a negative profile that corresponds with the exterior profile or configuration of the blades 52 and the junk slots 62 formed therebetween, as shown in FIGS. 1-2.

Various types of temporary displacement materials may be installed within mold cavity 104, depending upon the desired configuration of a resulting matrix drill bit. Additional mold inserts (not expressly shown) may be formed from various materials (e.g., consolidated sand and/or graphite) may be disposed within mold cavity 104. Such mold inserts may have configurations corresponding to the desired exterior features of the matrix drill bit (e.g., junk slots).

Displacement materials (e.g., consolidated sand) may be installed within the mold assembly 100 at desired locations to form the desired exterior features of the matrix drill bit (e.g., the fluid cavity and the flow passageways). Such displacement materials may have various configurations. For example, the orientation and configuration of the consolidated sand legs 142 and 144 may be selected to correspond with desired locations and configurations of associated flow passageways and their respective nozzle openings. The consolidated sand legs 142 and 144 may be coupled to threaded receptacles (not expressly shown) for forming the threads of the nozzle openings that couple the respective nozzles thereto.

A relatively large, generally cylindrically-shaped consolidated sand core 150 may be placed on the legs 142 and 144. Core 150 and legs 142 and 144 may be sometimes described as having the shape of a "crow's foot." Core 150 may also be referred to as a "stalk." The number of legs 142 and 144 extending from core 150 will depend upon the desired number of flow passageways and corresponding nozzle openings in a resulting matrix bit body. The legs 142 and 144 and the core 150 may also be formed from graphite or other suitable materials.

After desired displacement materials, including core 150 and legs 142 and 144, have been installed within mold assembly 100, the matrix material 130 may then be placed within or otherwise introduced into the mold assembly 100. In some embodiments, the matrix material 130 may comprise the reinforcing particles and the reinforcing fibers for forming fiber-reinforced hard composite portions, as described above. In other embodiments, however, the matrix material 130 may comprise the reinforcing particles and not comprise the reinforcing fibers for forming hard composite portions. As described further herein, different compositions of matrix material 130 may be used to achieve a fiber-reinforced bit body having different configurations of the fiber-reinforced hard composite portion and optionally the hard composite portion.

After a sufficient volume of matrix material 130 has been added to the mold assembly 100, the metal blank 36 may then be placed within mold assembly 100. The metal blank 36 preferably includes inside diameter 37, which is larger than the outside diameter 154 of sand core 150. Various fixtures (not expressly shown) may be used to position the metal blank 36 within the mold assembly 100 at a desired location. Then, the matrix material 130 may be filled to a desired level within the cavity 104.

Binder material 160 may be placed on top of the matrix material 130, metal blank 36, and core 150. In some embodiments, the binder material 160 may be covered with a flux layer (not expressly shown). A cover or lid (not expressly shown) may be placed over the mold assembly 100. The mold assembly 100 and materials disposed therein may then be preheated and then placed in a furnace (not expressly shown). When the furnace temperature reaches the melting point of the binder material 160, the binder material 160 may liquefy and infiltrate the matrix material 130.

After a predetermined amount of time allotted for the liquefied binder material 160 to infiltrate the matrix material 130, the mold assembly 100 may then be removed from the furnace and cooled at a controlled rate. Once cooled, the mold assembly 100 may be broken away to expose the matrix bit body that comprises the fiber-reinforced hard composite portion. Subsequent processing according to well-known techniques may be used to produce a matrix drill bit that comprises the matrix bit body.

In some embodiments, the fiber-reinforced hard composite portion may be homogeneous throughout the matrix bit body as illustrated in FIGS. 1-2.

In some embodiments, the fiber-reinforced hard composite portion may be localized in the matrix bit body with the remaining portion being formed by a hard composite (e.g., comprising binder and reinforcing particles and not comprising reinforcing fibers). Localization may, in some instances, provide mitigation for crack initiation and propagation while minimizing the additional cost that may be associated with some reinforcing fibers. Further, the inclusion of reinforcing fibers in the bit body may, in some instances, reduce the erosion properties of the bit body because of the lower concentration of reinforcing particles. Therefore, in some instances, localization of the reinforcing fibers to only a portion of the matrix bit body may mitigate any reduction in erosion properties associated with the use of fibers.

Figure 5:
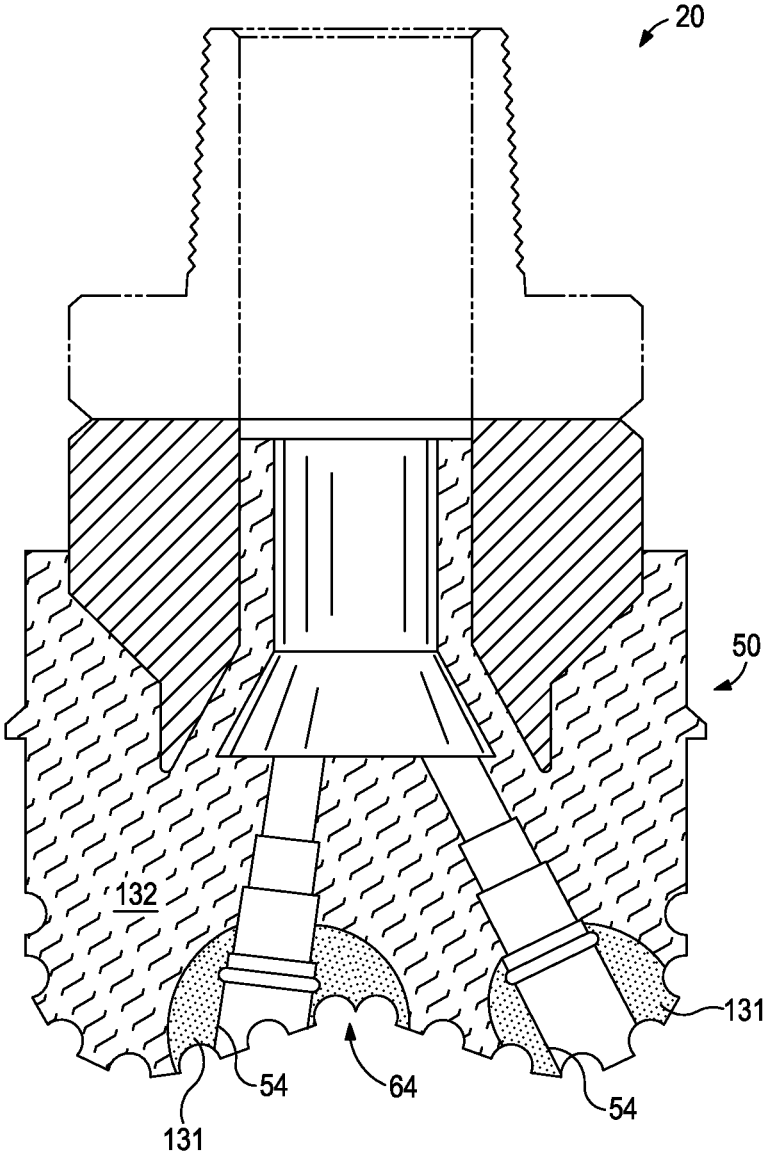
FIG. 5 is a cross-sectional view showing one example of a matrix drill bit in accordance with the teachings of the present disclosure.

For example, FIG. 5 is a cross-sectional view showing one example of a matrix drill bit 20 formed with a matrix bit body 50 that comprises a hard composite portion 132 and a fiber-reinforced hard composite portion 131 in accordance with the teachings of the present disclosure. The fiber-reinforced hard composite portion 131 is shown to be located proximal to the nozzle openings 54 and an apex 64, two areas of matrix bit bodies that typically have an increased propensity for cracking. As used herein, the term "apex" refers to the central portion of the exterior surface of the matrix bit body that engages the formation during drilling. Typically, the apex of a matrix drill bit is located at or proximal to where the blades 52 of FIG. 2 meet on the exterior surface of the matrix bit body that engages the formation during drilling.

Figure 6:
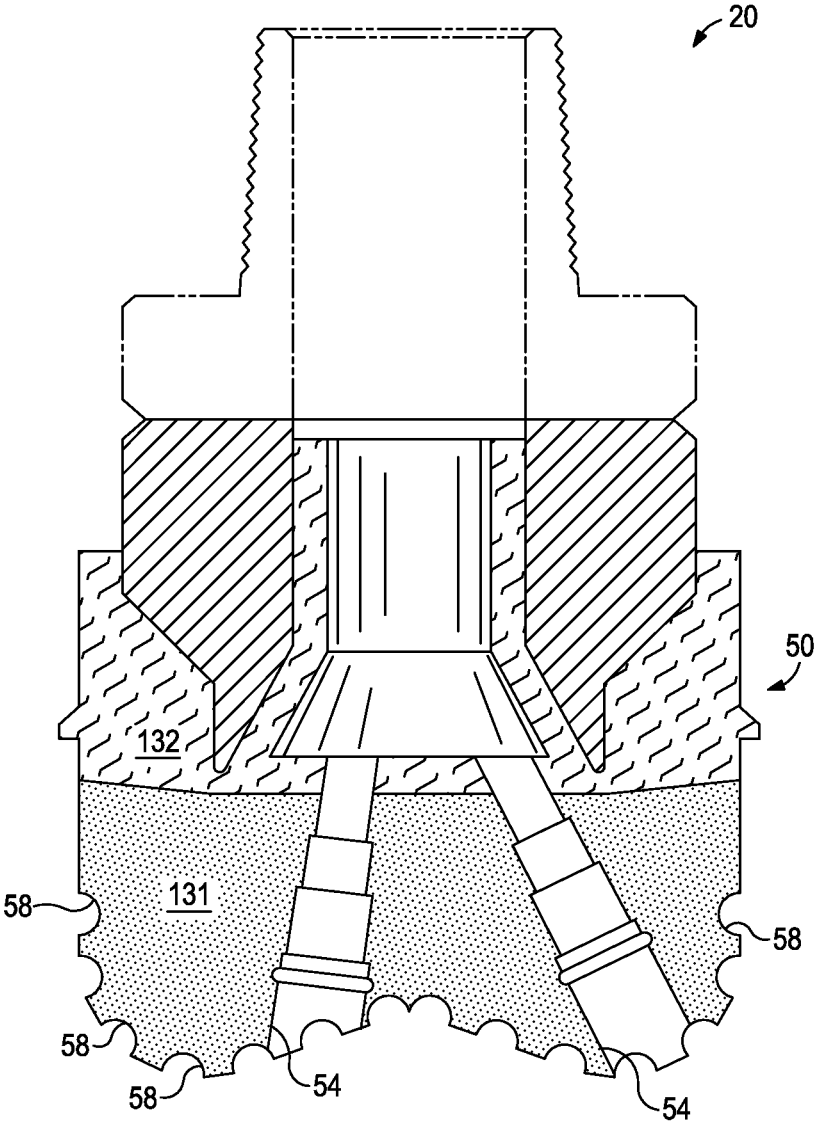
FIG. 6 is a cross-sectional view showing one example of a matrix drill bit in accordance with the teachings of the present disclosure.

In another example, FIG. 6 is a cross-sectional view showing one example of a matrix drill bit 20 formed with a matrix bit body 50 that comprises a hard composite portion 132 and a fiber-reinforced hard composite portion 131 in accordance with the teachings of the present disclosure. The fiber-reinforced hard composite portion 131 is shown to be located proximal to the nozzle openings 54 and the pockets 58.

In some embodiments, the reinforcing fibers may change in concentration, type of fibers, or both through the fiber-reinforced hard composite portion. Similar to localization, changing the concentration, composition, or both of the reinforcing fibers may, in some instances, be used to mitigate crack initiation and propagation while minimizing the additional cost that may be associated with some reinforcing fibers. Additionally, changing the concentration, composition, or both of the reinforcing fibers within the matrix bit body may be used to mitigate any reduction in erosion properties associated with the use of fibers.

Figure 7:
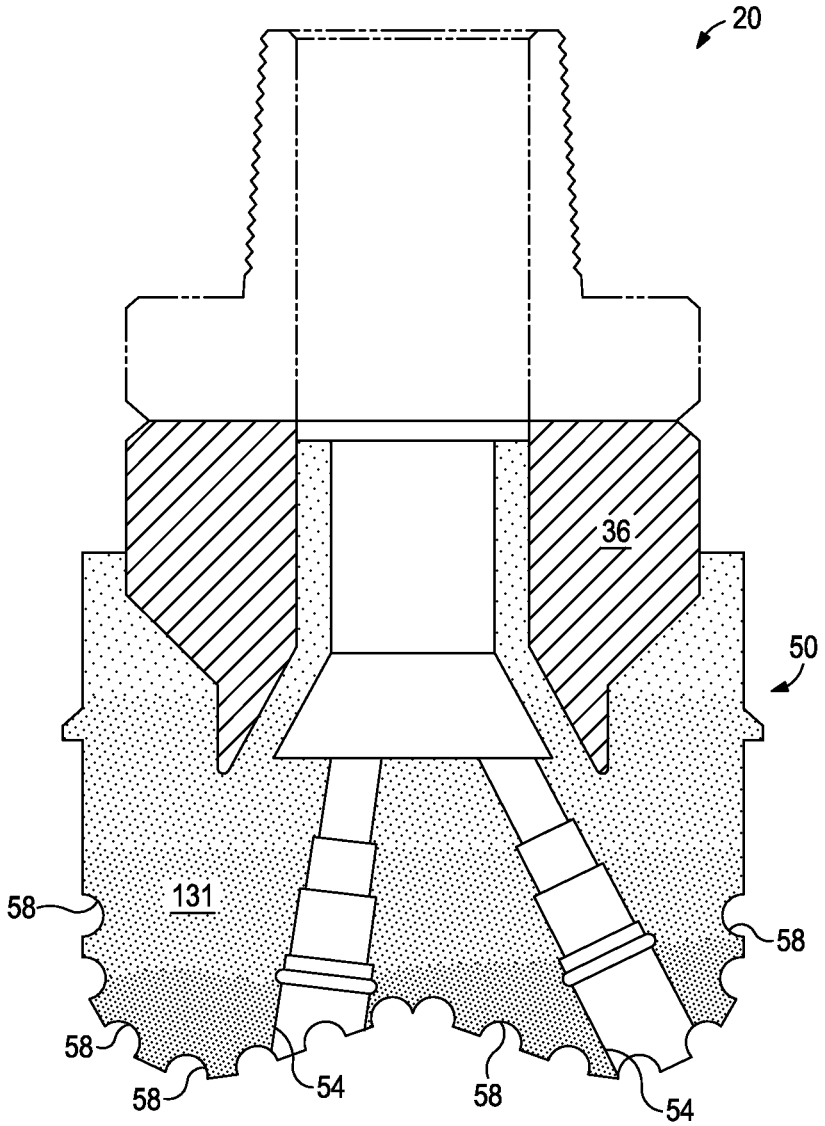
FIG. 7 is a cross-sectional view showing one example of a matrix drill bit in accordance with the teachings of the present disclosure.

For example, FIG. 7 is a cross-sectional view showing one example of a matrix drill bit 20 formed with a matrix bit body 50 that comprises a fiber-reinforced hard composite portion 131 in accordance with the teachings of the present disclosure. The concentration of the reinforcing fibers decreases or progressively decreases from the tip to the shank of the matrix bit body 50 (as illustrated by the degree of stippling in the matrix bit body 50). As illustrated, the highest concentration of the fiber-reinforced hard composite portion 131 is adjacent the nozzle openings 54 and the pockets 58 and the lower concentrations thereof are adjacent the metal blank 36.

Figure 8:
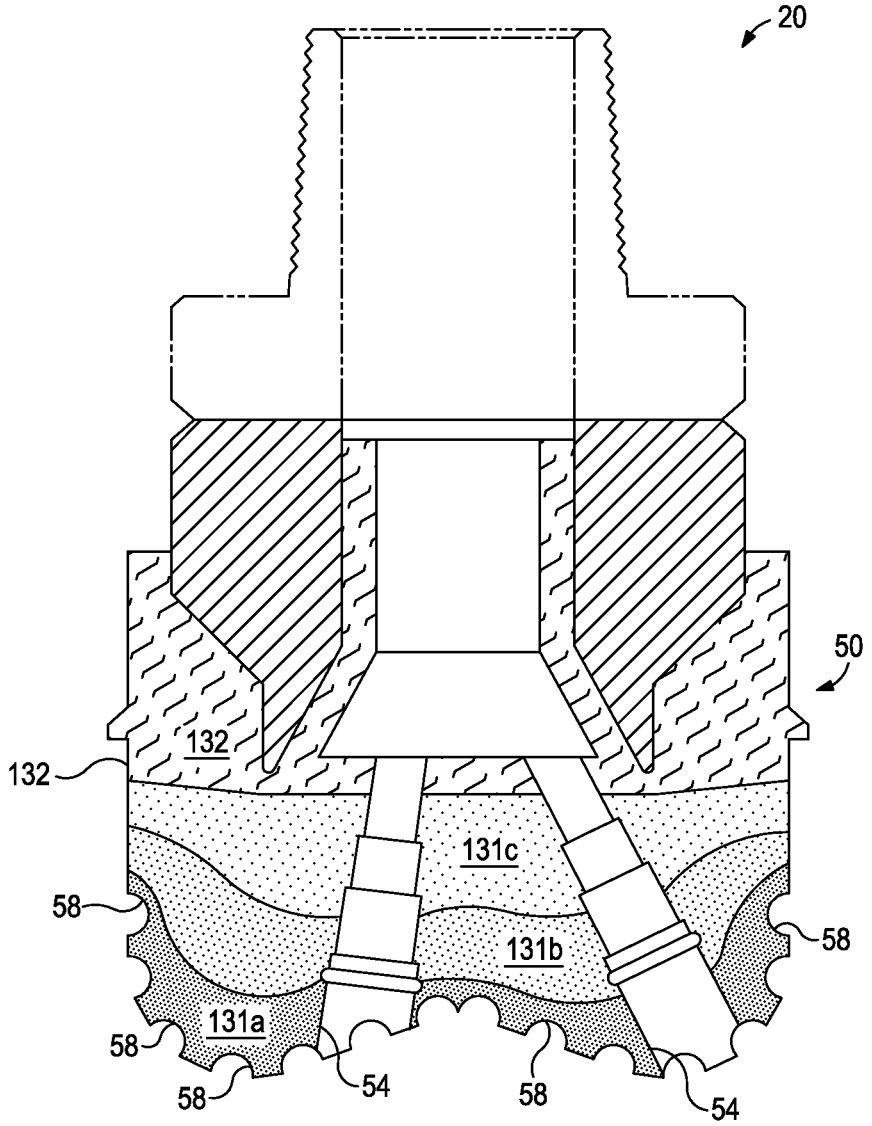
FIG. 8 is a cross-sectional view showing one example of a matrix drill bit in accordance with the teachings of the present disclosure.

In some instances, the concentration change of the reinforcing fibers in the fiber-reinforced hard composite portion may be gradual. In some instances, the concentration change may be more distinct and resemble layering or localization. For example, FIG. 8 is a cross-sectional view showing one example of a matrix drill bit 20 formed with a matrix bit body 50 that comprises a hard composite portion 132 and a fiber-reinforced hard composite portion 131 in accordance with the teachings of the present disclosure. The fiber-reinforced hard composite portion 131 is shown to be located proximal to the nozzle openings 54 and the pockets 58 in layers 131*a*, 131*b*, and 131*c*. The layer 131*a* with the highest concentration of reinforcing fibers is shown to be located proximal to the nozzle openings 54 and the pockets 58. The layer 131*c* with the lowest concentration of reinforcing fibers is shown to be located proximal to the hard composite portion 132. The layer 131*a* with the highest concentration of reinforcing fibers is shown to be disposed between layers 131*a* and 131*c*.

Alternatively, the fiber-reinforced hard composite portion of layers 131*a*, 131*b*, and 131*c* may vary by the reinforcing fibers composition or the diameter distribution of the reinforcing fibers and/or reinforcing particles rather than, or in addition to, a concentration change of the reinforcing fibers relative to the reinforcing particles.

One skilled in the art would recognize the various configurations and locations for the hard composite portion and the fiber-reinforced hard composite portion (including with varying concentrations of the reinforcing fibers) that would be suitable for producing a matrix bit body, and a resultant matrix drill bit, that has a reduced propensity to have cracks initiate and propagate.

Further, one skilled in the art would recognize the modifications to the composition of the matrix material 130 of FIG. 4 to form a matrix bit body according to the above examples in FIGS. 5-8 and other configurations within the scope of the present disclosure.

Figure 9:
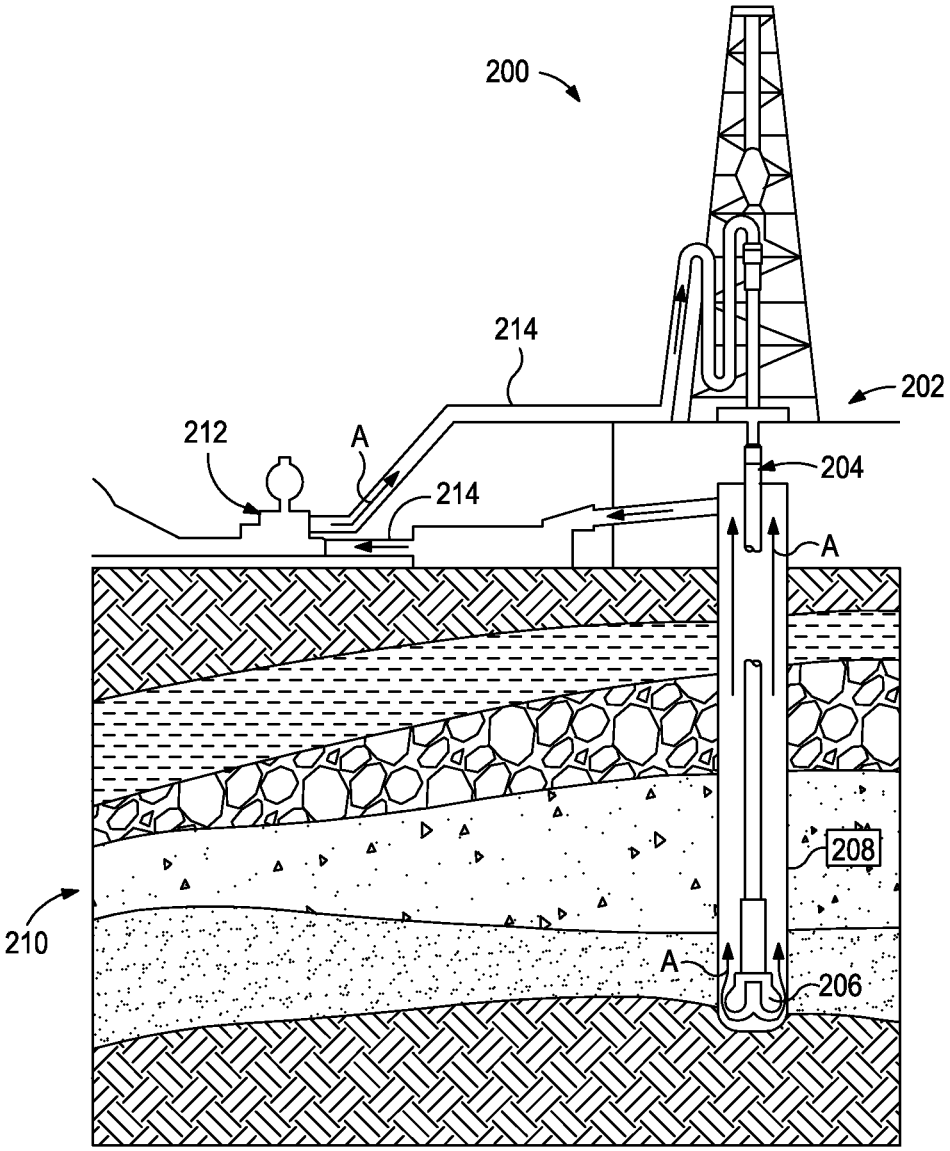
FIG. 9 is a schematic drawing showing one example of a drilling assembly suitable for use in conjunction with the matrix drill bits of the present disclosure.

FIG. 9 is a schematic showing one example of a drilling assembly 200 suitable for use in conjunction with the matrix drill bits of the present disclosure. It should be noted that while FIG. 9 generally depicts a land-based drilling assembly, those skilled in the art will readily recognize that the principles described herein are equally applicable to subsea drilling operations that employ floating or sea-based platforms and rigs, without departing from the scope of the disclosure.

The drilling assembly 200 includes a drilling platform 202 coupled to a drill string 204. The drill string 204 may include, but is not limited to, drill pipe and coiled tubing, as generally known to those skilled in the art. A matrix drill bit 206 according to the embodiments described herein is attached to the distal end of the drill string 204 and is driven either by a downhole motor and/or via rotation of the drill string 204 from the well surface. As the drill bit 206 rotates, it creates a wellbore 208 that penetrates the subterranean formation 210. The drilling assembly 200 also includes a pump 212 that circulates a drilling fluid through the drill string (as illustrated as flow arrows A) and other pipes 214.

One skilled in the art would recognize the other equipment suitable for use in conjunction with drilling assembly 200, which may include, but are not limited to, retention pits, mixers, shakers (e.g., shale shaker), centrifuges, hydrocyclones, separators (including magnetic and electrical separators), desilters, desanders, filters (e.g., diatomaceous earth filters), heat exchangers, and any fluid reclamation equipment. Further, the drilling assembly may include one or more sensors, gauges, pumps, compressors, and the like.

In some embodiments, the fiber-reinforced hard composite described herein may be implemented in other wellbore tools or portions thereof and systems relating thereto. Examples of wellbore tools where a fiber-reinforced hard composite described herein may be implemented in at least a portion thereof may include, but are not limited to, reamers, coring bits, rotary cone drill bits, centralizers, pads used in conjunction with formation evaluation (e.g., in conjunction with logging tools), packers, and the like. In some instances, portions of wellbore tools where a fiber-reinforced hard composite described herein may be implemented may include, but are not limited to, wear pads, inlay segments, cutters, fluid ports (e.g., the nozzle openings described herein), convergence points within the wellbore tool (e.g., the apex described herein), and the like, and any combination thereof.

Some embodiments may involve implementing a matrix drill bit described herein in a drilling operation. For example, some embodiments may further involve drilling a portion of a wellbore with a matrix drill bit.

Embodiments disclosed herein include:

A. a wellbore tool formed at least in part by a fiber-reinforced hard composite portion that comprises reinforcing particles and reinforcing fibers dispersed in a binder, wherein the reinforcing fibers have an aspect ratio ranging from 1 to 15 times a critical aspect ratio ($A_c$), wherein $A_c=\sigma_f/(2T_c)$, $\sigma_f$ is an ultimate tensile strength of the reinforcing fibers, and $T_c$ is an interfacial shear bond strength between the reinforcing fiber and the binder or a yield stress of the binder, whichever is lower, and wherein the reinforcing particles and the reinforcing fibers each have a diameter distribution characterized by a $d_{10}$ and a $d_{25}$ such that one of the following is satisfied: (1) the $d_{10}$ of the diameter distribution of the reinforcing particles is larger than the $d_{25}$ of the diameter distribution of the reinforcing fibers or (2) the $d_{10}$ of the diameter distribution of the reinforcing fibers is larger than the $d_{25}$ of the diameter distribution of the reinforcing particles; and B. a drill bit that includes a plurality of cutting elements coupled to an exterior portion of a matrix bit body, wherein at least a portion of the matrix bit body comprises a fiber-reinforced hard composite portion that comprises reinforcing particles and reinforcing fibers dispersed in a binder, wherein the reinforcing fibers have an aspect ratio ranging from 1 to 15 times a critical aspect ratio ($A_c$), wherein $A_c=\sigma_f/(2T_c)$, $\sigma_f$ is an ultimate tensile strength of the reinforcing fibers, and $T_c$ is an interfacial shear bond strength between the reinforcing fiber and the binder or a yield stress of the binder, whichever is lower, and wherein the reinforcing particles and the reinforcing fibers each have a diameter distribution characterized by a $d_{10}$ and a $d_{25}$ such that one of the following is satisfied: (1) the $d_{10}$ of the diameter distribution of the reinforcing particles is greater than 25 microns and the $d_{25}$ of the diameter distribution of the reinforcing fibers is less than 250 microns or (2) the $d_{10}$ of the diameter distribution of the reinforcing fibers is greater than 25 microns and the $d_{25}$ of the diameter distribution of the reinforcing particles is less than 250 microns.

Each of embodiments A, B, and C may have one or more of the following additional elements in any combination: Element 1: wherein the (1) is satisfied and the $d_{10}$ of the diameter distribution of the reinforcing particles is greater than 25 microns and the $d_{25}$ of the diameter distribution of the reinforcing fibers is less than 250 microns; Element 2: wherein the (2) is satisfied and the $d_{10}$ of the diameter distribution of the reinforcing fibers is greater than 25 microns and the $d_{25}$ of the diameter distribution of the reinforcing particles is less than 250 microns; Element 3: wherein the wellbore tool is a drill bit comprising: a matrix bit body comprising the fiber-reinforced hard composite portion; and a plurality of cutting elements coupled to an exterior portion of the matrix bit body; Element 4: Element 3 wherein the matrix bit body further comprises another hard composite portion with the reinforcing particles but without reinforcing fibers dispersed in the binder; Element 5: the wellbore tool of Element 4 further including a fluid cavity defined within the matrix bit body; at least one fluid flow passageway extending from the fluid cavity to the exterior portion of the matrix bit body; and at least one nozzle opening defined at an end of the at least one fluid flow passageway proximal to the exterior portion of the matrix bit body, wherein the fiber-reinforced hard composite portion is located proximal to the at least one nozzle opening; Element 6: the wellbore tool of Element 5 further including a plurality of cutter blades formed on the exterior portion of the matrix bit body; and a plurality of pockets formed in the plurality of cutter blades, wherein the fiber-reinforced hard composite portion is located proximal to the at least one nozzle opening and the plurality of pockets; Element 7: Element 4 wherein the fiber-reinforced hard composite portion is located at an apex of the matrix bit body; Element 8: Element 3 wherein essentially the entire matrix bit body consists of the fiber-reinforced hard composite portion; Element 9: Element 3 wherein a concentration of the reinforcing fibers is heterogeneous throughout the fiber-reinforced hard composite portion; and the wellbore tool further comprises: a fluid cavity defined within the matrix bit body; at least one fluid flow passageway extending from the fluid cavity to the exterior portion of the matrix bit body; and at least one nozzle opening defined at an end of the at least one fluid flow passageway proximal to the exterior portion of the matrix bit body, wherein the concentration of the reinforcing fibers is greatest proximal to the at least one nozzle opening; Element 10: the wellbore tool of Element 9 further including a plurality of cutter blades formed on the exterior portion of the matrix bit body; a plurality of pockets formed in the plurality of cutter blades, wherein the concentration of the reinforcing fibers is greatest proximal to the at least one nozzle opening and the plurality of pockets; Element 11: wherein a concentration of the reinforcing fibers is heterogeneous throughout the fiber-reinforced hard composite portion; Element 12: wherein at least some of the reinforcing fibers have an aspect ratio of 2 to 1000; Element 13: wherein at least some of the reinforcing fibers have a composition comprising at least one selected from the group consisting of tungsten, molybdenum, niobium, tantalum, rhenium, iridium, ruthenium, beryllium, titanium, chromium, rhodium, iron, cobalt, uranium, nickel, a steel, a stainless steel, a austenitic steel, a ferritic steel, a martensitic steel, a precipitation-hardening steel, a duplex stainless steel, an iron alloy, a nickel alloy, a chromium alloy, carbon, refractory ceramic, silicon carbide, silica, silicon nitride, alumina, titania, mullite, zirconia, boron nitride, boron carbide, titanium carbide, titanium nitride, tungsten carbide, and any combination thereof; Element 14: wherein the reinforcing fibers is present in the matrix bit body at 1% to 30% by weight of the reinforcing particles; and Element 15: wherein the wellbore tool is one of: a reamer, a coring bit, a rotary cone drill bit, a centralizer, a pad, or a packer.

By way of non-limiting example, exemplary combinations applicable to Embodiments A and B include: Element 1 in combination with Element 3 and optionally at least one of Elements 4-7; Element 1 in combination with Elements 3 and 8 and optionally at least one of Elements 9-10; Element 1 in combination with Elements 3 and 9-10; Element 2 in combination with Element 3 and optionally at least one of Elements 4-7; Element 2 in combination with Elements 3 and 8 and optionally at least one of Elements 9-10; Element 2 in combination with Elements 3 and 9-10; at least one of Elements 12-14 in combination with any of the foregoing; at least one of Elements 11-14 in combination with either Element 1 or 2; and Element 15 in combination with at least one of Elements 1-14 including the foregoing combinations.

Additional embodiments described herein include a drilling assembly that comprises a drill string extendable from a drilling platform and into a wellbore; a matrix drill bit attached to an end of the drill string; and a pump fluidly connected to the drill string and configured to circulate a drilling fluid to the matrix drill bit and through the wellbore, wherein the matrix drill bit may be according to Embodiment A or B, optionally including at least one of Elements 1-19.

One or more illustrative embodiments incorporating the invention embodiments disclosed herein are presented herein. Not all features of a physical implementation are described or shown in this application for the sake of clarity. It is understood that in the development of a physical embodiment incorporating the embodiments of the present invention, numerous implementation-specific decisions must be made to achieve the developer's goals, such as compliance with system-related, business-related, government-related and other constraints, which vary by implementation and from time to time. While a developer's efforts might be time-consuming, such efforts would be, nevertheless, a routine undertaking for those of ordinary skill in the art and having benefit of this disclosure.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from a to b," "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A wellbore tool comprising:

a fiber-reinforced hard composite portion that comprises reinforcing particles and reinforcing fibers dispersed in a binder, wherein the reinforcing fibers have an aspect ratio ranging from 1 to 15 times a critical aspect ratio ($A_c$), wherein $A_c=\sigma_f/(2\tau_c)$, $\sigma_f$ is an ultimate tensile strength of the reinforcing fibers, and $\tau_c$ is an interfacial shear bond strength between the reinforcing fiber and the binder or a yield stress of the binder, whichever is lower, and wherein the reinforcing particles comprise a particle diameter distribution with a particle $d_{10}$ diameter size and a particle $d_{25}$ diameter size, and the reinforcing fibers comprise a fiber diameter distribution with a fiber $d_{10}$ diameter size and a fiber $d_{25}$ diameter size, wherein the particle $d_{10}$ diameter size is 25 microns or more and the fiber $d_{25}$ diameter size is 250 microns or less, or the fiber $d_{10}$ diameter size is 25 microns or more and the particle $d_{25}$ diameter size is 250 microns or less.

2. The wellbore tool of claim 1, wherein the particle $d_{10}$ diameter size is larger than the fiber $d_{25}$ diameter size.

3. The wellbore tool of claim 1, wherein the fiber $d_{10}$ diameter size is larger than the particle $d_{25}$ diameter size.

4. The wellbore tool of claim 1, wherein the wellbore tool is a drill bit comprising:

a matrix bit body comprising the fiber-reinforced hard composite portion; and a plurality of cutting elements coupled to an exterior portion of the matrix bit body.

5. The wellbore tool of claim 4, wherein the matrix bit body further comprises another hard composite portion with the reinforcing particles but without reinforcing fibers dispersed in the binder.

6. The wellbore tool of claim 5 further comprising:

a fluid cavity defined within the matrix bit body;

at least one fluid flow passageway extending from the fluid cavity to the exterior portion of the matrix bit body; and at least one nozzle opening defined at an end of the at least one fluid flow passageway proximal to the exterior portion of the matrix bit body, wherein the fiber-reinforced hard composite portion is located proximal to the at least one nozzle opening.

7. The wellbore tool of claim 6 further comprising:

a plurality of cutter blades formed on the exterior portion of the matrix bit body; and a plurality of pockets formed in the plurality of cutter blades, wherein the fiber-reinforced hard composite portion is located proximal to the at least one nozzle opening and the plurality of pockets.

8. The wellbore tool of claim 5, wherein the fiber-reinforced hard composite portion is located at an apex of the matrix bit body.

9. The wellbore tool of claim 4, wherein essentially the entire matrix bit body consists of the fiber-reinforced hard composite portion.

10. The wellbore tool of claim 4, wherein a concentration of the reinforcing fibers is heterogeneous throughout the fiber-reinforced hard composite portion; and the wellbore tool further comprises:

a fluid cavity defined within the matrix bit body;

at least one fluid flow passageway extending from the fluid cavity to the exterior portion of the matrix bit body; and at least one nozzle opening defined at an end of the at least one fluid flow passageway proximal to the exterior portion of the matrix bit body, wherein the concentration of the reinforcing fibers is greatest proximal to the at least one nozzle opening.

11. The wellbore tool of claim 10 further comprising:

a plurality of cutter blades formed on the exterior portion of the matrix bit body;

a plurality of pockets formed in the plurality of cutter blades, wherein the concentration of the reinforcing fibers is greatest proximal to the at least one nozzle opening and the plurality of pockets.

12. The wellbore tool of claim 1, wherein the reinforcing fibers comprise an elongated structure with an end diameter greater than an elongated structure diameter.

13. The wellbore tool of claim 1, wherein at least some of the reinforcing fibers have an aspect ratio of 2 to 1000.

14. The wellbore tool of claim 1, wherein at least some of the reinforcing fibers have a composition comprising at least one selected from the group consisting of tungsten, molybdenum, niobium, tantalum, rhenium, iridium, ruthenium, beryllium, titanium, chromium, rhodium, iron, cobalt, uranium, nickel, a steel, a stainless steel, a austenitic steel, a ferritic steel, a martensitic steel, a precipitation-hardening steel, a duplex stainless steel, an iron alloy, a nickel alloy, a chromium alloy, carbon, refractory ceramic, silicon carbide, silica, silicon nitride, alumina, titania, mullite, zirconia, boron nitride, boron carbide, titanium carbide, titanium nitride, tungsten carbide, and any combination thereof.

15. The wellbore tool of claim 1, wherein the reinforcing fibers is present in the matrix bit body at 1% to 30% by weight of the reinforcing particles.

16. The wellbore tool of claim 1, wherein the wellbore tool is one of: a reamer, a coring bit, a rotary cone drill bit, a centralizer, a pad, or a packer.

17. A drill bit comprising:

a plurality of cutting elements coupled to an exterior portion of a matrix bit body, wherein at least a portion of the matrix bit body comprises a fiber-reinforced hard composite portion that comprises reinforcing particles and reinforcing fibers dispersed in a binder, wherein the reinforcing fibers have an aspect ratio ranging from 1 to 15 times a critical aspect ratio ($A_c$), wherein $A_c=\sigma_f/(2\tau_c)$, $\sigma_f$ is an ultimate tensile strength of the reinforcing fibers, and $\tau_c$ is an interfacial shear bond strength between the reinforcing fiber and the binder or a yield stress of the binder, whichever is lower, and wherein the reinforcing particles comprise a particle diameter distribution with a particle $d_{10}$ diameter size and a particle $d_{25}$ diameter size, and the reinforcing fibers comprise a fiber diameter distribution with a fiber $d_{10}$ diameter size and a fiber $d_{25}$ diameter size, wherein the particle $d_{10}$ diameter size is 25 microns or more and the fiber $d_{25}$ diameter size is 250 microns or less, or the fiber $d_{10}$ diameter size is 25 microns or more and the particle $d_{25}$ diameter size is 250 microns or less.

18. The drill bit of claim 17, wherein the matrix bit body further comprises another hard composite portion with the reinforcing particles but without reinforcing fibers dispersed in the binder.

19. The drill bit of claim 18 further comprising:

a fluid cavity defined within the matrix bit body;

at least one fluid flow passageway extending from the fluid cavity to the exterior portion of the matrix bit body;

at least one nozzle opening defined by an end of the at least one fluid flow passageway proximal to the exterior portion of the matrix bit body; and wherein the fiber-reinforced hard composite portion is located proximal to the at least one nozzle opening.

20. The drill bit of claim 19 further comprising:

a plurality of cutter blades formed on the exterior portion of the matrix bit body; and a plurality of pockets formed in the plurality of cutter blades, wherein the fiber-reinforced hard composite portion is located proximal to the at least one nozzle opening and the plurality of pockets.

21. A drilling assembly comprising:

a drill string extendable from a drilling platform and into a wellbore;

a drill bit attached to an end of the drill string; and a pump fluidly connected to the drill string and configured to circulate a drilling fluid to the drill bit and through the wellbore, wherein the drill bit comprises:

a matrix bit body; and a plurality of cutting elements coupled to an exterior portion of the matrix bit body, wherein the matrix bit body comprises a fiber-reinforced hard composite portion that comprises reinforcing particles and reinforcing fibers dispersed in a binder, wherein the reinforcing fibers have an aspect ratio ranging from 1 to 15 times a critical aspect ratio ($A_c$), wherein $A_c=\sigma_f/(2\tau_c)$, $\sigma_f$ is an ultimate tensile strength of the reinforcing fibers, and $\tau_c$ is an interfacial shear bond strength between the reinforcing fiber and the binder or a yield stress of the binder, whichever is lower, and wherein the reinforcing particles comprise a particle diameter distribution with a particle $d_{10}$ diameter size and a particle $d_{25}$ diameter size, and the reinforcing fibers comprise a fiber diameter distribution with a fiber $d_{10}$ diameter size and a fiber $d_{25}$ diameter size, wherein the particle $d_{10}$ diameter size is 25 microns or more and the fiber $d_{25}$ diameter size is 250 microns or less, or the fiber $d_{10}$ diameter size is 25 microns or more and the particle $d_{25}$ diameter size is 250 microns or less.

* * * * *